US011259624B2

(12) United States Patent
Tabesh Nekoo

(10) Patent No.: US 11,259,624 B2
(45) Date of Patent: Mar. 1, 2022

(54) PAINT APPLICATOR WITH BRUSH

(71) Applicant: Masoud Tabesh Nekoo, Tujunga, CA (US)

(72) Inventor: Masoud Tabesh Nekoo, Tujunga, CA (US)

( * ) Notice: Subject to any disclaimer, the term of this patent is extended or adjusted under 35 U.S.C. 154(b) by 0 days.

(21) Appl. No.: 16/668,421

(22) Filed: Oct. 30, 2019

(65) Prior Publication Data

US 2021/0127822 A1 May 6, 2021

(51) Int. Cl.
*A46B 11/00* (2006.01)

(52) U.S. Cl.
CPC ..... *A46B 11/0041* (2013.01); *A46B 11/0062* (2013.01); *A46B 11/0089* (2013.01); *A46B 2200/202* (2013.01)

(58) Field of Classification Search
CPC ... A46B 11/0041; A46B 11/00; A46B 11/001; A46B 11/002; A46B 11/0062; A46B 11/0065; A46B 11/0079; A46B 11/0086; A46B 11/0089; A46B 2200/202; A45D 40/262; A45D 19/02; A45D 19/026; A45D 24/26; A45D 34/02
See application file for complete search history.

(56) References Cited

U.S. PATENT DOCUMENTS 453,639 A * 6/1891 Ingraham ..... A46B 11/0041 401/288
1,960,387 A * 5/1934 Marcher ..... B65D 35/36 401/99
2,994,897 A * 8/1961 Snable ..... A46B 11/0041 401/186
2,996,749 A * 8/1961 Hester ..... A46B 11/0013 401/117
3,690,777 A * 9/1972 Costa ..... A45D 34/045 401/17
4,040,753 A * 8/1977 Griffith ..... A45D 34/042 401/186
4,447,169 A * 5/1984 Vartoughian ..... A45D 34/042 401/126
4,748,990 A * 6/1988 Brown ..... B65D 47/242 132/320
4,780,017 A * 10/1988 Bradford ..... A45D 34/045 401/123
4,902,152 A * 2/1990 Seidler ..... A45D 34/043 401/116
5,888,009 A * 3/1999 Toyama ..... B43K 5/1845 401/188 A
5,975,089 A * 11/1999 Simon ..... A45D 24/26 132/112
7,293,931 B2 * 11/2007 Lee ..... A45D 34/00 401/269

(Continued)

*Primary Examiner* — Patrick M. Buechner
(74) *Attorney, Agent, or Firm* — Averill & Green; Kenneth L Green

(57) ABSTRACT

A paint container includes a brush attached to the container. The brush is in fluid communication with the interior of the container to receive paint through passages reaching into the interior of the container. A container cap is attachable over the brush to prevent paint on the brush from drying out between use. The container includes a diaphragm in at least one side allowing a user to create pressure inside the container to urge paint into the brush. One example of suitable paint is water based paint.

17 Claims, 2 Drawing Sheets

(56) References Cited

U.S. PATENT DOCUMENTS

| | | | | |
|---|---|---|---|---|
| 7,419,323 | B1 * | 9/2008 | Zhang | A45D 34/042 401/183 |
| 8,075,215 | B2 * | 12/2011 | Albisetti | A45D 34/042 401/284 |
| 8,662,775 | B1 * | 3/2014 | Liu | A45D 40/24 401/19 |
| 2003/0152410 | A1 * | 8/2003 | Huang | A46B 15/0055 401/19 |
| 2004/0021000 | A1 * | 2/2004 | Denisov | B65D 47/42 239/44 |
| 2005/0019084 | A1 * | 1/2005 | Gueret | A45D 40/24 401/25 |
| 2006/0140708 | A1 * | 6/2006 | Byun | A46B 11/0041 401/270 |
| 2009/0254055 | A1 * | 10/2009 | Clarke | A45D 34/041 604/309 |
| 2016/0075169 | A1 * | 3/2016 | O'Connor | B43K 23/12 401/195 |
| 2017/0006998 | A1 * | 1/2017 | Liu | A45D 34/04 |
| 2017/0215551 | A1 * | 8/2017 | Kim | A45D 40/265 |

* cited by examiner

PAINT APPLICATOR WITH BRUSH

BACKGROUND OF THE INVENTION

The present invention relates to paint and in particular to a paint containing applicator including a brush.

There is often a desire to apply small amounts of paint. For example, touch-up, or painting finger nails. Small paint applicators are available with brushes attached to bottle lids. Unfortunately, such brushes may not reach to the bottom of the paint bottle and some of the paint is wasted. Also, extracting the brush may result in dripping and paint being spilled.

BRIEF SUMMARY OF THE INVENTION

The present invention addresses the above and other needs by providing a paint container which includes a brush attached to the container. The brush is in fluid communication with the interior of the container to receive paint through passages reaching into the interior of the container. A container cap is attachable over the brush to prevent paint on the brush from drying out between use. The container includes a diaphragm in at least one side allowing a user to create pressure inside the container to urge paint into the brush. One example of suitable paint is water based paint.

In accordance with one aspect of the invention, there is provided a paint container with a brush attached to the container and receiving paint from the container. Feeding paint directly into the brush prevents or reduces spilling paint.

In accordance with another aspect of the invention, there is provided a paint container with an insertable and removable brush cartridge. The brush cartridge may be an interference fit to the container, be a threaded fit, a snap in fit, or any other suitable fit.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Where the terms "about" or "generally" are associated with an element of the invention, it is intended to describe a feature's appearance to the human eye or human perception, and not a precise measurement, or typically within 10 percent of a stated value.

Figure 1A:
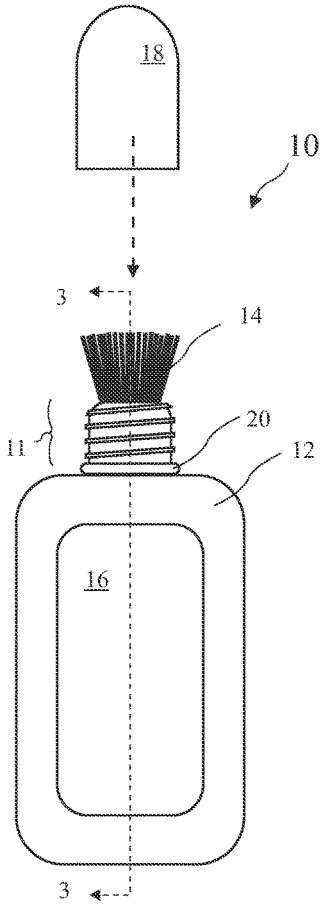
FIG. 1A shows a front view of a paint applicator with a brush attached to a paint container according to the present invention.
Figure 1B:
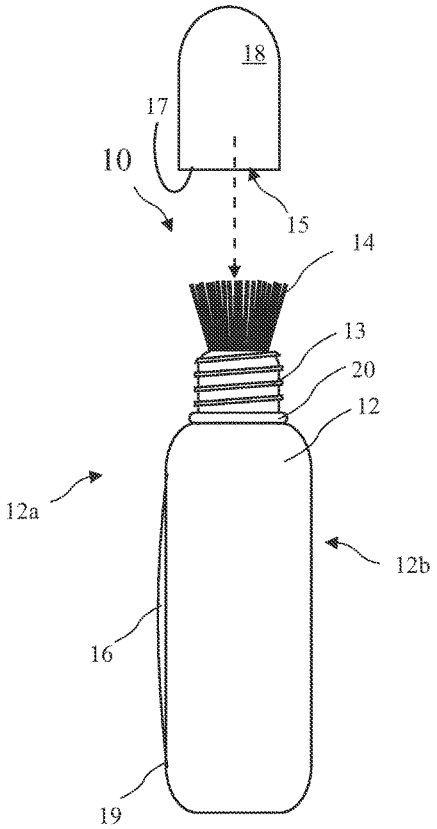
FIG. 1B shows a side view of the paint applicator with the brush attached to the paint container according to the present invention.

A front view of a paint applicator 10 with a brush 14 attached to the paint container 12 according to the present invention is shown in FIG. 1A and a side view of the paint applicator 10 with the brush 14 is shown in FIG. 1B. The paint applicator 10 includes the container 12, brush 14, and at least one diaphragm 16 in a generally flat front 12*a* and/or generally flat rear 12*b* of the container 12. The diaphragm 16 may be squeezed to urge paint into the brush 14. A seal 20, for example, an O-Ring, resides on a container shoulder 21 under a cap 18 between the cap 18 and shoulder 21 for sealing to a removable and attachable cap 18. A container neck 11 may include cap attaching features 13, for example male threads, and cooperating features 15 may reside inside the cap 18.

Figure 2:
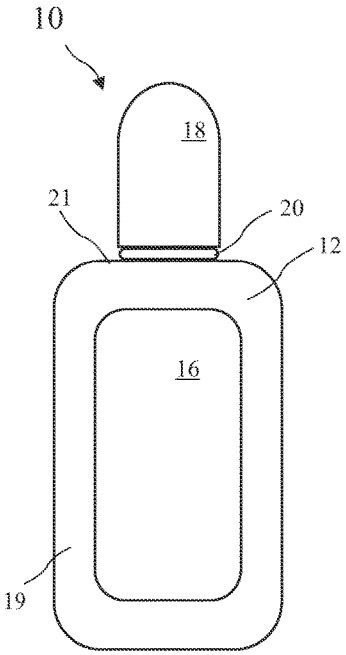
FIG. 2 shows a front view of the paint applicator with a cap attached to the paint container according to the present invention.

A front view of the paint applicator 10 with a cap 18 attached to the container 12 is shown in FIG. 2. The cap 18 is tightened against the seal 20 to prevent or reduce paint in the brush drying.

Figure 3:
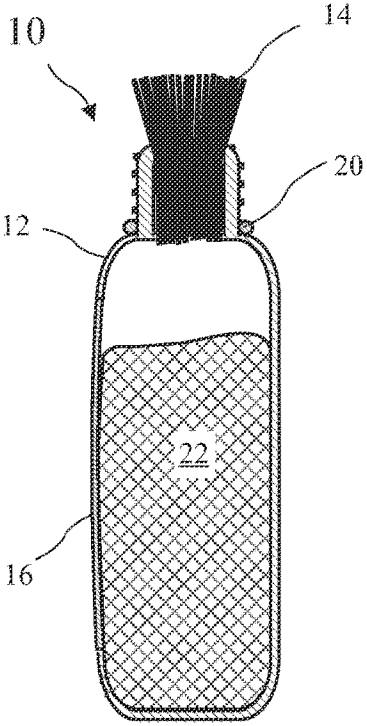
FIG. 3 shows a side cross-sectional view of the paint applicator with the brush attached to the container, taken along line 4-4 of FIG. 1A, according to the present invention.

FIG. 3 shows a side cross-sectional view of the paint applicator 10 taken along line 4-4 of FIG. 1A. Paint 22 resides in the container 12 and is released into the brush 14. The paint 22 may be any paint, for example water base paint, or water base finger nail paint.

Figure 4:
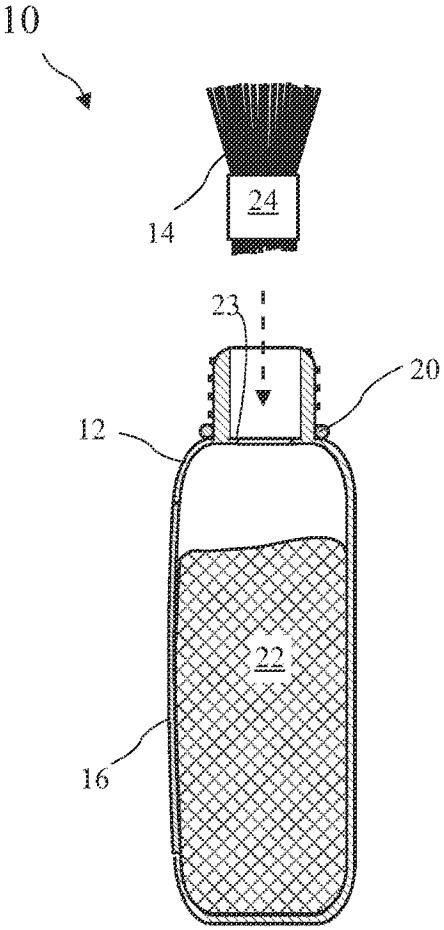
FIG. 4 shows a side cross-sectional view of the paint applicator with the brush separated from the container, taken along line 4-4 of FIG. 1A, according to the present invention.

A side cross-sectional view of the paint applicator 10 with the brush 14 separated from the container 12, taken along line 4-4 of FIG. 1A, is shown in FIG. 4. The brush 14 is shown fixed to a ring 24. The ring 24 may be an interference fit, a threaded fit, a snap in fit, or any other suitable fit to the container 12 and is preferably removable and replaceable and the brush 14 may be held in the ring 24 by crimping the ring 24 onto the brush 14 reaching entirely through the ring 24. The ring 24 seats to a depth proximal to the shoulder of the container against a stop 23 proximal to the shoulder 21 of the container 12. The brush 14 is removable to refill the container 12 with paint 22, or to clean the brush 14.

Figure 5:
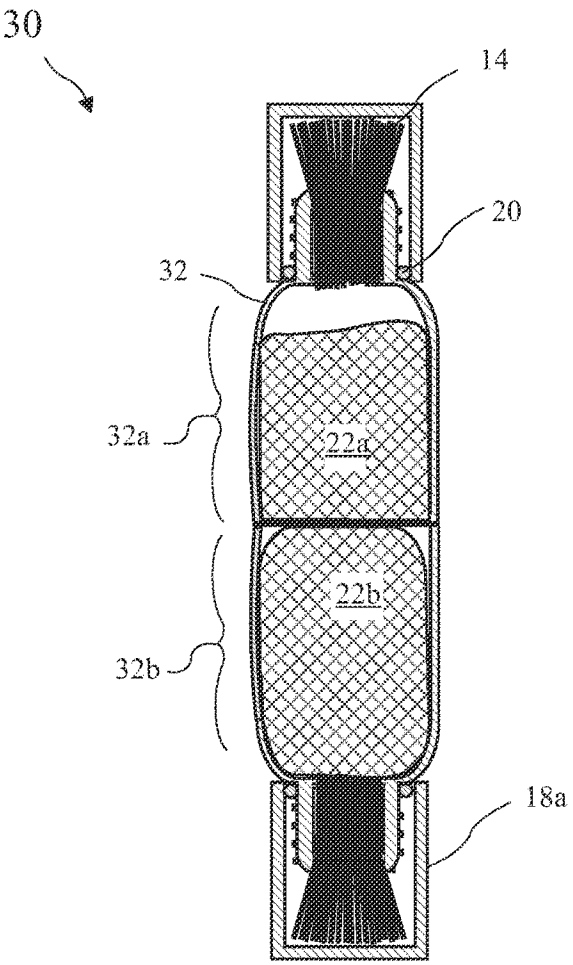
FIG. 5 shows a double ended paint applicator according to the present invention.

A double ended paint applicator 30 is shown in FIG. 5. The applicator 30 includes a container 32 have two compartment 32*a* do 32*b*, each holding paint. Caps 18*a* reside on the brushes 14. The caps 18*a* preferably are flat to allow the applicator 30 to rest on one cap while the opposite cap is removed.

While the invention herein disclosed has been described by means of specific embodiments and applications thereof, numerous modifications and variations could be made thereto by those skilled in the art without departing from the scope of the invention set forth in the claims.

I claim:

1. A paint applicator, comprising:

a container configured to hold a portion of paint and having a generally flat front and a generally flat rear;

at least one diaphragm extending out from the front or the rear of the paint container;

a neck reaching up from the container;

a brush reaching up from the neck; and a cap attachable and removable from the container to reside over the brush, further including a seal residing on a shoulder of the container between the cap and the container.

2. The paint applicator of claim 1, wherein the portion of paint is a portion of water base paint.

3. The paint applicator of claim 1, wherein the seal resides under a base of the cap and between the cap and the shoulder.

4. The paint applicator of claim 1, wherein the cap engages threads on the neck to attach the cap to the container.

5. The paint applicator of claim 1, wherein the diaphragm is surrounded by a generally flat outer portion of the generally flat front and the generally flat rear of the container and extends out from that surface.

6. The paint applicator of claim 1, wherein: the brush is removable and replaceable from the container.

7. The paint applicator of claim 6, wherein the ring is an interference fit into the neck.

8. The paint applicator of claim 6, wherein the neck includes a stop proximal to the shoulder of the container and ring seats against the stop.

9. The paint applicator of claim 8, wherein the stop is at a bottom of the neck proximal to the shoulder of the container.

10. The paint applicator of claim 6, wherein the brush is fixed to a ring, and the ring is removable and replaceable from the neck.

11. The paint applicator of claim 10, wherein the brush reaches entirely through the ring.

12. The paint applicator of claim 11, wherein the brush reaches towards the container to a depth proximal to the shoulder of the container.

13. A paint applicator, comprising:

a container configured to hold a portion of paint and having a generally flat front and a generally flat rear;

at least one front diaphragm in the front of the paint container or at least one rear diaphragm in the rear of the paint container and reaching out from the generally flat front or the generally flat rear and surrounded by a generally flat surface and extends out from the generally flat surface;

a neck reaching up from a shoulder of the container;

a removable and replaceable brush reaching up from the neck;

a ring holding the brush, the ring removable and replaceable from the neck;

a stop inside the neck, the ring seating against the stop;

a cap attachable and removable from the container to reside over the brush; and a seal between the cap and the container, wherein the brush reaches entirely through the ring to a depth proximal to the shoulder of the container.

14. The paint applicator of claim 13, wherein:

the container is configured to hold first and second portions of the paint;

the shoulders comprise first and second shoulders at opposite ends of the container;

the neck comprises first and second necks reaching up from a respective one of the first and second shoulders;

the removable and replaceable brush comprises first and second removable and replaceable brushes, each of the first and second brushes reaching up from a respective one of the first and second necks;

the ring holding the brushes comprises first and second rings holding a respective one of the first and second brushes;

the stop comprises first and second stops inside a respective one of the first and second necks, the first and second rings seating against a respective one of the first and second stops;

the cap comprises first and second caps, each of the first and second caps attachable and removable from the container to reside over a respective one of the first and second brushes;

the seal comprises respective first and second seals between the first and second caps and the container; and wherein the respective first and second brushes reach entirely through the respective first and second rings to a depth proximal to the shoulder of the container.

15. A paint applicator, comprising:

a container holding a portion of water base paint and having a front and a rear;

at least one diaphragm in the front or the rear of the paint container;

a neck reaching up from a shoulder of the container;

a removable and replaceable brush reaching up from the neck;

a ring holding the brush, the ring removable and replaceable from the neck, and the ring seated against a stop inside the neck proximal to the shoulder of the container;

a cap attachable and removable from the container to reside over the brush; and an O-Ring around a base of the neck and sealing between the cap and the container.

16. The paint applicator of claim 15, wherein:

the container is configured with an upper compartment and a lower compartment to hold first and second portions of the water base paint;

the shoulder comprises a first shoulder positioned adjacent the upper compartment and a second shoulder positioned adjacent the lower compartment;

the neck comprises first and second necks, each of the first and second necks reaching out from a respective one of the first and second shoulders;

the base of the neck comprises first and second bases of a respective one of the first and second necks;

the removable and replaceable brush comprises first and second removable and replaceable brushes, each of the first and second brushes reaching up from a respective one of the first and second necks;

the O-Ring comprises first and second O-Rings, each of the first and second O-Rings positioned around a respective base of a respective one of the first and second necks and sealing between a respective one of the first and second caps and the container;

the ring comprises first and second rings holding a respective one of the first and second brushes, the first and second rings removable and replaceable from a respective one of the first and second necks, and the first and second rings seated against a respective first and second stops inside a respective one of the first and second necks proximal a respective first and second shoulders of the container;

the cap comprises first and second caps, each of the first and second caps attachable and removable from the container to reside over a respective one of the first and second brushes; and the O-ring comprises first and second O-Rings around a respective one of the first and second bases of the first and second necks and sealing between a respective one of the first and second caps and the container.

17. The paint applicator of claim 15, wherein the diaphragm is surrounded by a generally flat surface and extends out from that surface.

* * * * *